US009944444B2

(12) United States Patent
Presche

(10) Patent No.: US 9,944,444 B2
(45) Date of Patent: Apr. 17, 2018

(54) MIXING/CLOSURE DEVICE FOR A CONTAINER AND METHOD FOR DISPENSING A MEDIUM FROM A CLOSURE DEVICE

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/309,099

(22) PCT Filed: May 6, 2015

(86) PCT No.: PCT/EP2015/059905
§ 371 (c)(1),
(2) Date: Nov. 4, 2016

(87) PCT Pub. No.: WO2015/169824
PCT Pub. Date: Nov. 12, 2015

(65) Prior Publication Data

US 2017/0073133 A1 Mar. 16, 2017

(30) Foreign Application Priority Data

May 7, 2014 (DE) ..... 10 2014 106 369
May 28, 2014 (DE) ..... 10 2014 107 547
Sep. 12, 2014 (DE) ..... 10 2014 113 201

(51) Int. Cl.
*B65D 51/28* (2006.01)
*B65D 39/08* (2006.01)
*B65D 53/06* (2006.01)

(52) U.S. Cl.
CPC ..... *B65D 51/2892* (2013.01); *B65D 39/08* (2013.01); *B65D 53/06* (2013.01)

(58) Field of Classification Search
CPC ..... B65D 81/3211; B65D 81/3238; B65D 81/3266; B65D 51/2892; B65D 39/08;
(Continued)

(56) References Cited

U.S. PATENT DOCUMENTS 3,404,811 A 10/1968 Cernei
4,903,828 A 2/1990 Finke et al.
(Continued)

FOREIGN PATENT DOCUMENTS

DE 36 01 493 A1 7/1986
DE 36 06 224 U1 7/1987
(Continued)

OTHER PUBLICATIONS

International Search Report of PCT/EP2015/059901, dated Aug. 14, 2015.
(Continued)

*Primary Examiner* — Steven A. Reynolds
(74) *Attorney, Agent, or Firm* — Collard & Roe, P.C.

(57) ABSTRACT

A closure device for a container, having a lid element for closing the container opening, a chamber which is arranged on the lid element for storing a medium, and an inner housing. The chamber and the inner housing have corresponding closure means and opening means. A discharge opening paired with the chamber can be released by moving the lid element relative to the inner housing such that a medium can exit the chamber into the container. The chamber and the inner housing each have a corresponding first thread which is formed relative to a winding rotational axis. The first winding which is located on the chamber is arranged so as to point radially outwards when seen from the winding rotational axis.

9 Claims, 8 Drawing Sheets

(58) Field of Classification Search
CPC B65D 53/06; B65D 51/2807; B65D 51/2814; B65D 51/2835; B65D 51/285; B65D 51/2864; A61J 1/2093
USPC ..... 206/219, 222
See application file for complete search history.

(56) References Cited

U.S. PATENT DOCUMENTS

| | | | | |
|---|---|---|---|---|
| 5,353,928 | A | 10/1994 | Schumacher | |
| 5,419,445 | A | 5/1995 | Kaesemeyer | |
| 5,465,835 | A | 11/1995 | Schumacher et al. | |
| 7,025,200 | B2 * | 4/2006 | Fontana | A61J 1/2093 206/222 |
| 7,210,575 | B2 * | 5/2007 | Oswald | B65D 51/2885 206/219 |
| 8,151,985 | B2 * | 4/2012 | Owoc | B65D 25/08 206/219 |
| 8,672,154 | B2 | 3/2014 | Seelhofer | |
| 8,672,156 | B2 * | 3/2014 | Martinovic | B65D 51/18 215/227 |
| 2002/0066677 | A1 | 6/2002 | Moscovitz | |
| 2003/0213709 | A1 | 11/2003 | Gibler et al. | |
| 2003/0222102 | A1 | 12/2003 | Cho | |
| 2005/0016875 | A1 * | 1/2005 | Rodriguez | B65D 51/2814 206/219 |
| 2008/0290061 | A1 | 11/2008 | Seelhofer | |
| 2008/0314775 | A1 | 12/2008 | Owoc | |
| 2009/0321286 | A1 | 12/2009 | Frutin | |
| 2014/0110281 | A1 | 4/2014 | Chen | |

FOREIGN PATENT DOCUMENTS

| | | | |
|---|---|---|---|
| DE | 89 00 291 | U1 | 5/1990 |
| DE | 299 22 042 | U1 | 2/2000 |
| DE | 10 2006 047 593 | A1 | 5/2007 |
| DE | 10 2007 011 392 | B3 | 1/2008 |
| EP | 0 520 207 | A1 | 12/1992 |
| EP | 1 975 080 | A1 | 10/2008 |
| EP | 2 383 201 | A1 | 11/2011 |
| EP | 2 240 382 | B1 | 12/2012 |
| FR | 2129923 | A1 | 11/1972 |
| GB | 1231770 | A | 5/1971 |
| WO | 91/17930 | A2 | 11/1991 |
| WO | 2005/014428 | A1 | 2/2005 |
| WO | 2006/037244 | A1 | 4/2006 |
| WO | 2007/129116 | A1 | 11/2007 |
| WO | 2008/017890 | A1 | 2/2008 |
| WO | 2008/072918 | A1 | 6/2008 |

OTHER PUBLICATIONS

International Search Report of PCT/EP2015/059905, dated Aug. 18, 2015.

* cited by examiner

MIXING/CLOSURE DEVICE FOR A CONTAINER AND METHOD FOR DISPENSING A MEDIUM FROM A CLOSURE DEVICE

CROSS REFERENCE TO RELATED APPLICATIONS

This application is the National Stage of PCT/EP2015/059905 filed on May 6, 2015, which claims priority under 35 U.S.C. § 119 of German Application No. 10 2014 106 369.4 filed on May 7, 2014, German Application No. 10 2014 107 547.1, filed May 28, 2014, and German Application No. 10 2014 113 201.7 filed on Sep. 12, 2014, the disclosures of which are incorporated by reference. The international application under PCT article 21(2) was not published in English.

The invention firstly relates to a closure device for a container.

The invention further relates to a closure device for dispensing a medium.

Furthermore, the invention relates to a method for dispensing a medium from a closure device.

Closure devices of the aforesaid type are known in the prior art. These serve to close a container, for example a drinks bottle and at the same time provide a chamber for separate storage of liquid or powdery ingredients, for example, tea essences so that these do not come in contact and/or are mixed with the contents of the container, i.e. for example water, directly during filling but only at the moment when the closure device is removed from the container. This is usually the moment when a user would like to consume the beverage located in the container.

The closure devices known in the prior art usually consist of a lid element on which the chamber is arranged and an inner housing. The closure device is usually screwed onto the container as a whole, i.e. fully pre-assembled. For this purpose the inner housing has a thread corresponding positively with the thread of the container. Furthermore, lid element and inner housing are interconnected via positively corresponding threads. During opening of the container, i.e. when unscrewing the lid element, the lid element—and therefore also the chamber arranged on the lid element—is moved relative to the inner housing. Preferably in particular in the case of unscrewing, this comprises a combined turning and vertical movement. In this case, the lid element is moved from a closing position to a discharge position in which discharge position a medium stored in the chamber can exit into the container. To this end chamber and inner housing have corresponding closure means and opening means for closing or opening the discharge opening. These corresponding closure and opening means can be formed on the inner housing, for example, in the form of a single stopper element arranged on the inner housing, wherein a first end region forms the closure means and a second end region forms the opening means. The stopper element depending on its position inside the outlet opening of the chamber prevents or allows an exit of the medium into the container. The closure or opening means can be formed on the chamber as a discharge opening, for example, as a receiver for the stopper element which in a first position cooperates with the closure and opening means of the inner housing so that no medium can exit from the chamber and in a second position so that medium can exit. Alternatively however the corresponding closure and opening means can also be separate elements which in any case do not cooperate directly in the closed state, such as for example a membrane closing the outlet opening of the chamber and a mandrel arranged on the inner housing. During a movement of the lid element relative to the inner housing, the closure means is destroyed by the opening means wherein the discharge opening of the chamber is released and the medium can exit into the container.

The document WO 2007/129116 A1 (US 2009/0321286 A1) relates, for example, to a closure device according to the prior art for attachment to a container. The closure device comprises a lid element which defines a chamber and an inner housing with a stopper element which can be engaged sealingly in a discharge opening in a lower wall of the chamber. The lid element is provided with a thread which can engage in a corresponding thread of the inner housing to enable the lid element to be displaced relative to the inner housing from a closed position in which the stopper element closes the discharge opening of the chamber into a discharge position in which the stopper element is at least partially withdrawn from the discharge opening in order to release a discharge channel arranged between chamber and container.

Known from US 2008/0314775 A1 is a closure device with a lid element, wherein the lid element is fastened to the chamber. The lid element is not fastened directly to the container. The known container is not fastened directly on the container. The known container can be opened at two points.

Known from US 2014/0110281 A1 is a closure device in which the lid element with first thread means is received in an adapter part and the adapter part for its part again with second thread means is screwed on the container. A twofold opening of the container is possible.

For the prior art reference is further made to U.S. Pat. No. 5,419,445 A and EP 0 520 207 A1.

Although closure devices of this type known in the prior art for closing plastic containers have proved successful, they are not readily suitable for the closure of glass containers. In particular, the known closure devices require a precise dimensioning of the container in the area of the container opening for an optimal tight fit and tightness. However these requirements frequently cannot be met during the manufacture of glass bottles.

This object is initially solved in that a second thread for connection to the container is provided on the lid element, wherein the lid element is a plastic part and comprises second threads or the lid element is an aluminium element and comprises the moulded-on second thread. This object is also solved in that the chamber has an opening with a collar-shaped chamfered edge region on which edge region the lid element is welded on for closing the opening.

The object is further solved in that in order to implement a discharge position the lid element and the container are moved away from one another in order to bring about a longitudinal movement between the lid element and the container, corresponding second threads formed on the lid element and the container are rotated with respect to one another.

The relative movement of the chamber with respect to the inner housing is made possible by corresponding threads arranged on the chamber and the inner housing. The formation of the first thread on the chamber so as to point radially outwards when viewed from the thread axis of rotation enables the chamber including the thread to be arranged inside the container. In this case, chamber and inner housing remain in engagement with one another even in the discharge position so that the inner housing with the chamber arranged on the lid element can be removed from the container.

The second thread means on the lid element for connection to the container only enables an opening of the container.

The possible configuration of the welding of the container onto the lid enables an independent formation of the container from the lid.

It is therefore the object of the present invention to provide a closure device which in particular is suitable for the closure of a glass container.

As a result of the shift according to the invention of the first thread into the inner region of the container, the tight fit of the closure device on the container no longer depends on a precise dimensioning of the container in the region of the container opening. On the contrary, the tightness of the container closed with the closure device can also be ensured if the container, in particular a glass bottle, has dimensional deviations.

In order to compensate for any dimensional deviations, a preferably elastic seal can be arranged particularly simply between the inner housing of the closure device and the inner wall of the container in the region of the container opening.

It is recommended that the inner housing in particular on the side facing away from the first thread has a press seal for bearing against a container in the region of the container opening. This press seal can particularly advantageously be welded onto the inner housing. Dimensional fluctuations during manufacture of the glass bottle can be compensated by the elasticity of the press seal so that the closure device optimally seals the container opening.

It is further provided that the lid element is an aluminium element which is rolled to form a second thread on the container, wherein the second thread formed on the lid element corresponds to a second thread of the container. In this case, the aluminium element serving as lid element is rolled onto the outer wall of the container in the region of the container opening, whereby the thread is stamped into the lid element. Lid element and container are therefore positively corresponding elements which ensure the tightness of the container closed with the closure device. It is also advantageous here that a technology can be used during manufacture of the lid element which is already regularly used for the closure of glass bottles with aluminium lids.

By welding the chamber onto the lid element, customary and particularly cost-effective joining methods can thus be used during manufacture of the closure device. Furthermore it is additionally also achieved that the lid element simultaneously closes an opening formed in the chamber. The lid element therefore functions both as a closure element for the opening of the chamber and also as a closure element for the container per se. By means of the welding a particularly fluid-tight and permanent connection can be made between the chamber and the lid element. The welding can be accomplished in various ways, for example, by means of ultrasound, induction or also resistance heating.

With the chamfered edge region at the opening of the chamber, the chamber advantageously has a type of connecting flange which is aligned substantially parallel to an adjacent surface of the lid element. The collar-shaped chamfered edge region can in particular be a region of the chamber wall chamfered by 90°. The collar-shaped chamfered edge region can in particular be a region of the wall of the chamber chamfered by 90°. By this means a region which is aligned parallel to the surface of the lid element is formed in a particularly simple manner. Advantageously the chamber can be connected to the lid element along this—preferably annular —region, i.e. along the opening. During the welding process this region is advantageously used to weld the lid element to the chamber. In order to increase the adhesion between the aluminium lid element and the chamber, it is additionally recommended that the lid element is coated with a lacquer in the region of the weld point. The lacquer should be adapted in its composition to the respective material of the chamber.

It can further be provided that the chamfered edge region of the chamber in the radial direction of the closure element projects over an adjacently arranged edge region of the inner housing. Thus a "protrusion" or a projecting "lug" is provided on the lid element around which the aluminium of the lid element is rolled so that the connection between chamber and lid element is additionally reinforced. It is thus ensured that when twisting-off the lid element from the container, the chamber is also moved at the same time.

Alternatively to the previously described configuration of the lid element of aluminium, the invention proposes that the lid element is a plastic element which has a second thread corresponding to a second thread of the container. According to this embodiment, the second thread of the lid element is not stamped during connection to the container but rather during manufacture of the lid element itself, i.e. before the final assembly on the container.

As already set out in relation to the aluminium lid element, it is also recommended in connection with the plastic lid element that the inner housing on the side facing away from the chamber has a press seal for bearing against the container in the region of the container opening. In this respect, the necessary tightness of the container screwed to the closure device is ensured.

It is additionally proposed that the chamber has an opening with a collar-shaped chamfered edge region on which edge region a film element for closing the opening is welded on, which film element is connected to the lid element. According to this embodiment, the chamber is configured as a container which is open on one side, the opening of which points in the direction of the lid element in the assembled state of the closure device. This opening can be used to equip the chamber with, for example, the closure means and opening means in a simple manner so that before connection of chamber and lid element—as is also possible previously in relation to the aluminium lid—a ready pre-assembled "chamber unit" is provided which then only needs to be connected to the lid element. The closure device can thus be manufactured particularly rapidly and cost-effectively.

Since a film element which closes the opening of the chamber in a fluid-tight manner is additionally arranged between the chamber and the lid element, the necessary tightness of the closure device is also ensured.

It is provided that the film element is welded to at least one sub-region of the chamber and at least one sub-region of the lid element. Alternatively to welding, the connection between the film element and the lid element can also be made by other technologies, for example, by adhesive bonding or similar. With reference to a welding process it can be provided that either all three parts—chamber, film element, lid element—are welded together substantially at the same weld points, in particular also at the same time or that alternatively the weld points differ spatially. The latter is particular appropriate when the melting points of the materials of lid element and chamber are so different that there is a risk that one of the materials is heated beyond its melting point. In this case, it is recommended to separate the weld points spatially from one another. For example, lid element and film element can be welded together in the area of the opening of the chamber whereas chamber and film element are welded together in the area of the collar-shaped chamfered edge region of the chamber.

The material of the lid element is usually PP (polypropylene). PP has a melting point of about 210° C. On the other hand, the material of the chamber, PBT (polybutylene terephthalate) has a melting point of about 320° C. Thus, the temperature required for welding chamber and film element is higher than the temperature required for welding lid element and film element. The chamber and the film element should therefore advantageously be welded together independently of the lid element so that the material of the lid element is not adversely affected. The lid element and the film element can then be welded together temporally and spatially separately. The location of the weld connection of lid element and film element is then not fixed on the region of the collar-shaped chamfered edge region but can in principle lie in the entire contact region of lid element and film element, for example, in the area of the opening of the chamber.

The film element is preferably an aluminium film. Aluminium films are gas- and airtight as well as soft and flexible after heat treatment. They are therefore particularly suitable for the packaging of foodstuffs.

In order to increase the adhesion between the aluminium film and the chamber or the aluminium film and the lid element, it is recommended that the aluminium film is coated with a lacquer. The lacquer should be adapted in its composition to the material of the chamber or the lid element.

Alternatively the film element can also be a multilayer film comprising plastics, wherein the plastics are adapted to the materials of the lid element and the chamber. If the lid element is for example made of PP and the chamber is made of PBT, a multilayer film which successively comprises the layers PP, EVOH, PBT can be used. EVOH (ethylene vinyl alcohol copolymer) is a copolymer regularly used for the packaging of foodstuffs. In particular this provides a barrier for oxygen and carbon dioxide. In addition, a primer can be provided between the layers of PP and EVOH or EVOH and PBT, which additionally increases the adhesion between the adjacent layers.

If the chamber is not provided with an opening, this can alternatively be over-moulded with the material of the lid element for connection to the lid element.

In addition to the previously presented closure device for a container, the invention also proposes a container having an aforesaid closure device wherein the container has a second thread in the region of the container opening, which is connected in a positively corresponding manner to a second thread of a lid element.

Furthermore, the invention also proposes a method for dispensing a medium from a closure device into a container, in particular from a closure device presented previously, wherein the closure device has a lid element for closing a container opening, a chamber arranged on the lid element and an inner housing, wherein corresponding closing means and opening means assigned to the chamber and the inner housing interact with one another during a movement of the lid element relative to the inner housing so that a discharge opening assigned to the chamber is released, so that a medium stored in the chamber exits into the container, wherein during the movement of the lid element the chamber and the inner housing are moved towards one another by means of a corresponding first thread formed on the chamber and inner housing, wherein the chamber is moved by means of a radially outwardly pointing first thread when viewed from a thread axis of rotation of the closure device.

A method is therefore proposed according to the invention in which the rotary movement accomplished in the prior art between lid element and inner housing is accomplished by means of threads arranged on the chamber and inner housing. The method according to the invention is in particular advantageous for closure devices on glass containers.

The invention is explained in detail hereinafter with reference to exemplary embodiments. In the figures.

Figure 1:
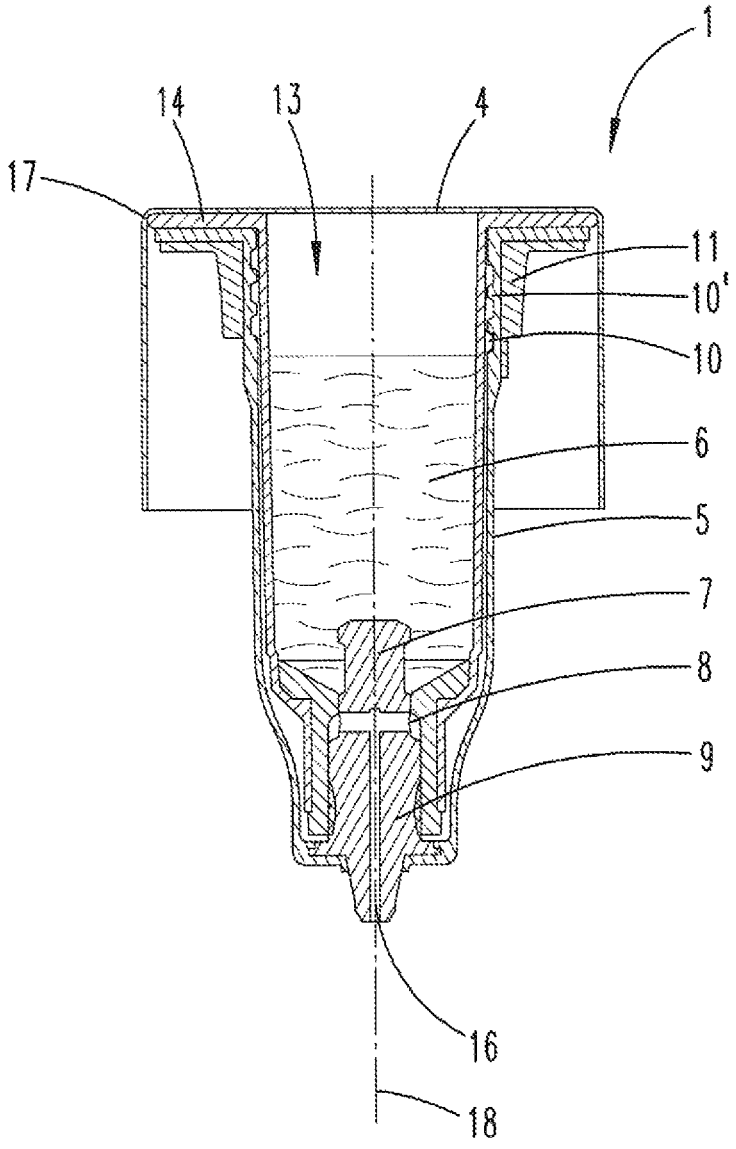
FIG. 1 shows a closure device according to the invention with an aluminium lid element before rolling onto a container.

FIG. 1 shows a closure device 1 according to a first embodiment with an aluminium lid element 4 before rolling onto a container 2. The lid element 4 has no thread in relation to an outer wall to be applied to a container 2.

Figure 2:
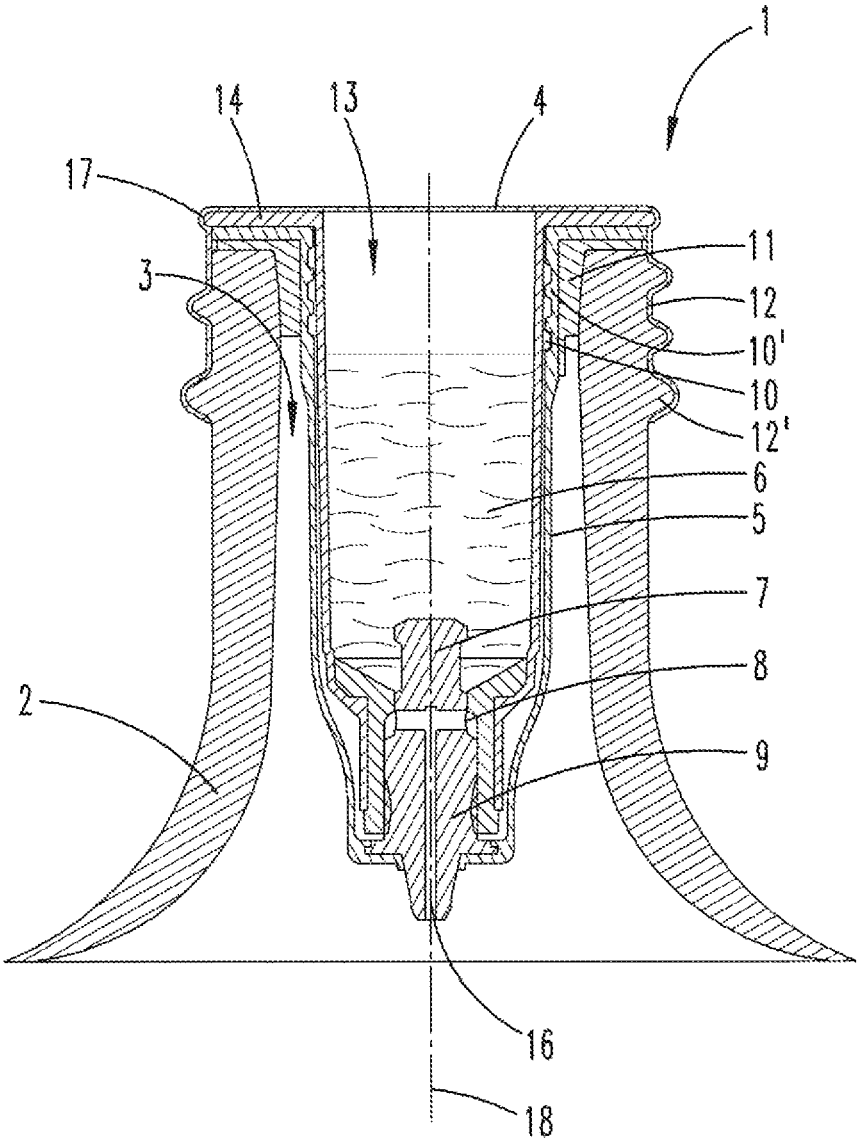
FIG. 2 shows a closure device according to the invention with aluminium lid element rolled onto the container in the closed position.

FIG. 2 shows the closure device 1 according to FIG. 1 after rolling onto a container 2. The closure device 1 is completely pre-assembled and screwed on a container 2 so that a container opening 3 of the container 2 is closed #. In this state the container 2 can be stored for a fairly long time without the contents of the container 2 being able to escape. As a result of the rolling onto the container 2, a second thread 12 is formed on the lid element 4 which corresponds to a second thread 12 of the container 2.

The closure device 1 comprise a lid element 4, a chamber 6 arranged on the lid element 4 as well as an inner housing 5. In the embodiment shown the lid element 4 is an aluminium lid. The lid element 4 is welded onto the chamber 6. The chamber 6 can, for example, be formed of a plastic such as PBT (polybutylene terephthalate). In order to be able to weld the chamber 6 to the lid element 4 made of aluminium, an aluminium with a lacquer for PBT is recommended for the lid element 4. The chamber 6 has an opening 13 in its region directed in the direction of the lid element 4, which can be used before covering with the lid element 4 in order to mount further elements of the closure device 1. These elements for example comprise closure means 7 and opening means 9 for closure or opening of a discharge opening 8 located in the chamber 6. The discharge opening 8 is advantageously directed away from the lid element 4 ("downwards" in relation to the closure device 1 shown in FIG. 2).

The chamber 6 has a collar-shaped chamfered edge region 14 in the region of the opening 13. The lid element 4 can be welded onto this edge region 14.

The chamber 6 is connected to the inner housing 5 by means of a corresponding first thread 10, 10'. In this case, the first thread formed on the chamber 6 is arranged on the chamber so that it points radially outwards when viewed from a thread axis of rotation 18 of the closure device. This means that the first thread 10 is formed radially outside to the chamber 6 and inside the inner housing 5 in relation to a vertical projection in the direction of the thread axis of rotation 18. The inner housing 5 has a corresponding thread 10'. The thread 10' points radially inwards. The inner housing 5 is pressed into the container 2 in the region of the container opening 13 by means of a rotation preventing element configured here as press seal 11. The lid element 4 and the container 2 furthermore have corresponding second threads 12, 12' by means of which the lid element 4 is connected to the container 2.

Furthermore, in a cross-section transverse to the thread axis of rotation 18 the chamber 6 has the flange-like radially outwardly projecting edge region 14 wherein the first thread 10 is formed radially inside in relation to an outer edge of the edge region 14.

The manufacture of the aforesaid closure device 1 and its arrangement on the container 2 is accomplished such that firstly the chamber 6 is fitted with the closure means 7 or opening means 9 which respectively close or open the discharge opening 8 of the chamber 6. In the example shown, closure means 7 and opening means 9 are configured as a stopper element formed in one piece, which is inserted into the opening or closure means of the chamber 6, here given by the discharge opening 8 of the chamber 6. The sub-region pointing in the direction of the lid element 4, i.e. the closure means 7 is formed so that according to the position inside the discharge opening 8 it either closes this discharge opening 8 or releases a discharge channel 16 through which the medium located in the chamber 6 can flow out into the container 2. The opening means 9 which is directed away from the lid element 4 has a discharge channel 16 through which the medium can flow into the container 2. The opening means 9 is connected to the inner housing 5. In the example shown here, an edge region formed on the opening means 9 is over-moulded by the material of the inner housing 5. Alternatively however, this could also involve a press fit.

After preparation of the chamber 6 has been completed, this is connected to the lid element 4, whereby at the same time the opening 13 of the chamber 6 is closed. In this case, the chamfered edge region 14 of the chamber 6 is welded to the lid element 4. In this state, the lid element 4 still comprises a blank which still has no second thread 12 for connection to the container 2. In a following step the inner housing 5 is let into the container 2 via the container opening 3. In this case, the inner housing 5 is pressed into the container opening 3 together with a press seal 11 arranged on the inner housing 5. Finally the chamber 6 with the lid element 4 arranged thereon is introduced into the inner housing 5, wherein chamber 6 and inner housing 5 are screwed together by means of the corresponding first thread 10, 10'. During this screw movement at the same time the lid element 4 is rolled onto the second thread 12' of the container 2, whereby a second thread 12 is also formed in the lid element 4.

Alternatively to the previously depicted method of manufacture, the welding of chamber 6 and lid element 4 can be accomplished only when the lid element 4 is screwed to the container 2.

For the connection of chamber 6 and lid element 4 it can additionally be advantageous to form the chamfered edge region 14 in relation to its radial dimension so that this projects over the surface of the container 2 so that a projection 17 is obtained in the region of the container opening 3. During rolling of the lid element 4 onto the container 2, the material of the lid element 4 lays over his projection 17 so that the connection is additionally strengthened by this means.

Figure 3:
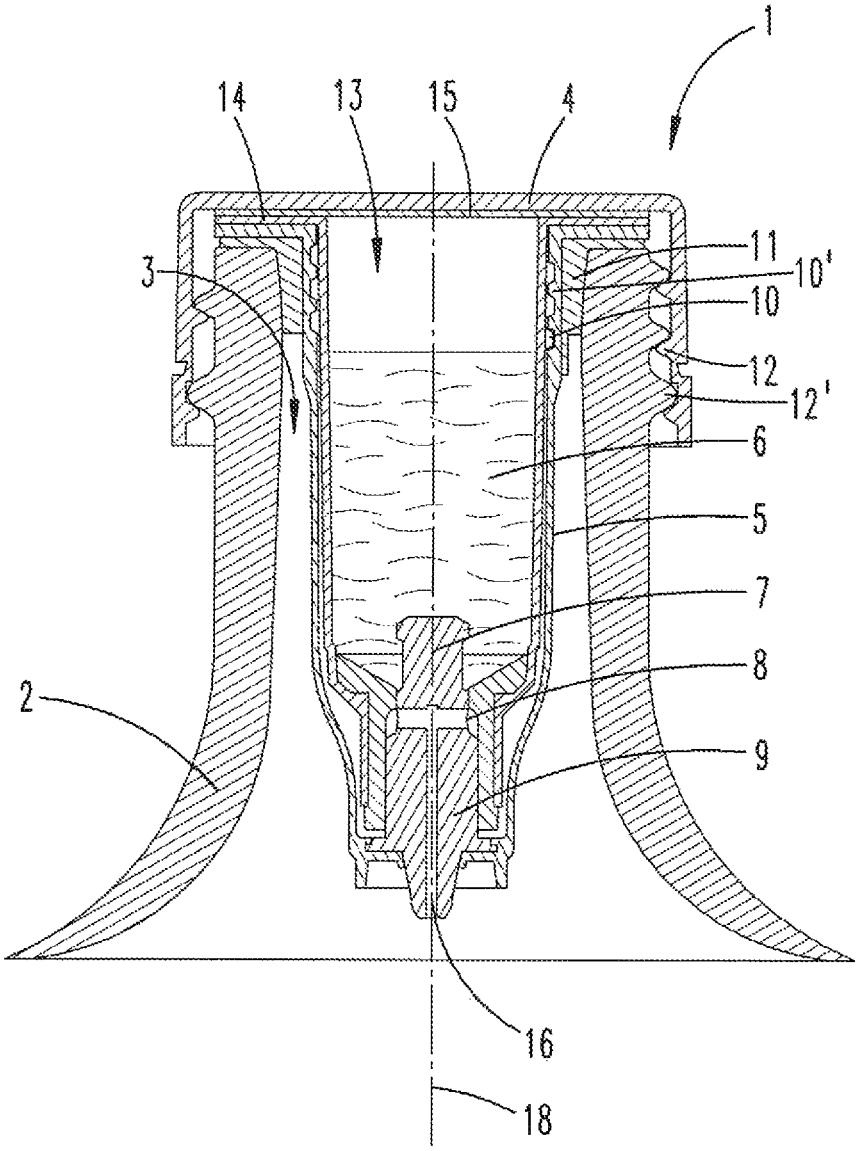
FIG. 3 shows a closure device according to the invention with plastic lid element in the closed position.

FIG. 3 shows an alternative embodiment of a closure device 1 according to the invention. The lid element 4 of this closure device 1 preferably consists of a plastic, for example, PP (polypropylene) or PE (polyethylene). The fundamental structure of the closure device 1 is similar to that shown in FIG. 1. However, since the lid element 4 does not consist of aluminium but rather of a plastic, it is not possible to roll the lid element 4 onto the container 2.

According to FIG. 3, the chamber 6 is closed in the region of its opening 13 with a film element 15. This film element 15 is advantageously an aluminium film but can however also consist of a plastic material, for example EVOH (ethylene vinyl alcohol copolymer), PET (polyethylene terephthalate) or similar. In the event that the film element 15 consists of aluminium, this is preferably coated on the side pointing in the direction of the chamber 6 with a varnish for the material of the chamber 6, in particular PBT. On the opposite side of the film element 15 pointing in the direction of the lid element 4, a lacquer is advantageously applied which is suitable for connection to the lid element 4. If the lid element 4 consists of PP for example, a lacquer for PP is recommended. In a following process step the film element 15 is welded onto the chamber 6 or the lid element 4. The welding can either be accomplished in a joint process step or in consecutive steps, wherein the film element 15 is, for example, firstly welded onto the chamber 6 and only onto the lid element 4 in a following step.

In addition, the closure device 1 according to FIG. 3 already has a second thread 12 formed on the lid element 4 for connection to the container 2.

The closure devices 1 according to FIGS. 2 and 3 are shown in a closure position. In this case, the container 2 is connected in a fluid-tight manner to the closure device 1, i.e. the closure means 7 are located inside the discharge opening 8 of the chamber 6 so that the medium stored in the chamber 6 cannot flow through the discharge chamber 16 but on the contrary is enclosed in the chamber 6.

The medium enclosed in the chamber 6 is preferably under pressure. For this purpose in the closed state in the case of a liquid medium, a pressurized gas chamber can be formed above a liquid level.

In order to now discharge the medium stored in the chamber 6 into the container 2, it is necessary to bring the closure device 1 into a discharge position. The steps to be undertaken for this are explained in detail in the following.

Figure 4:
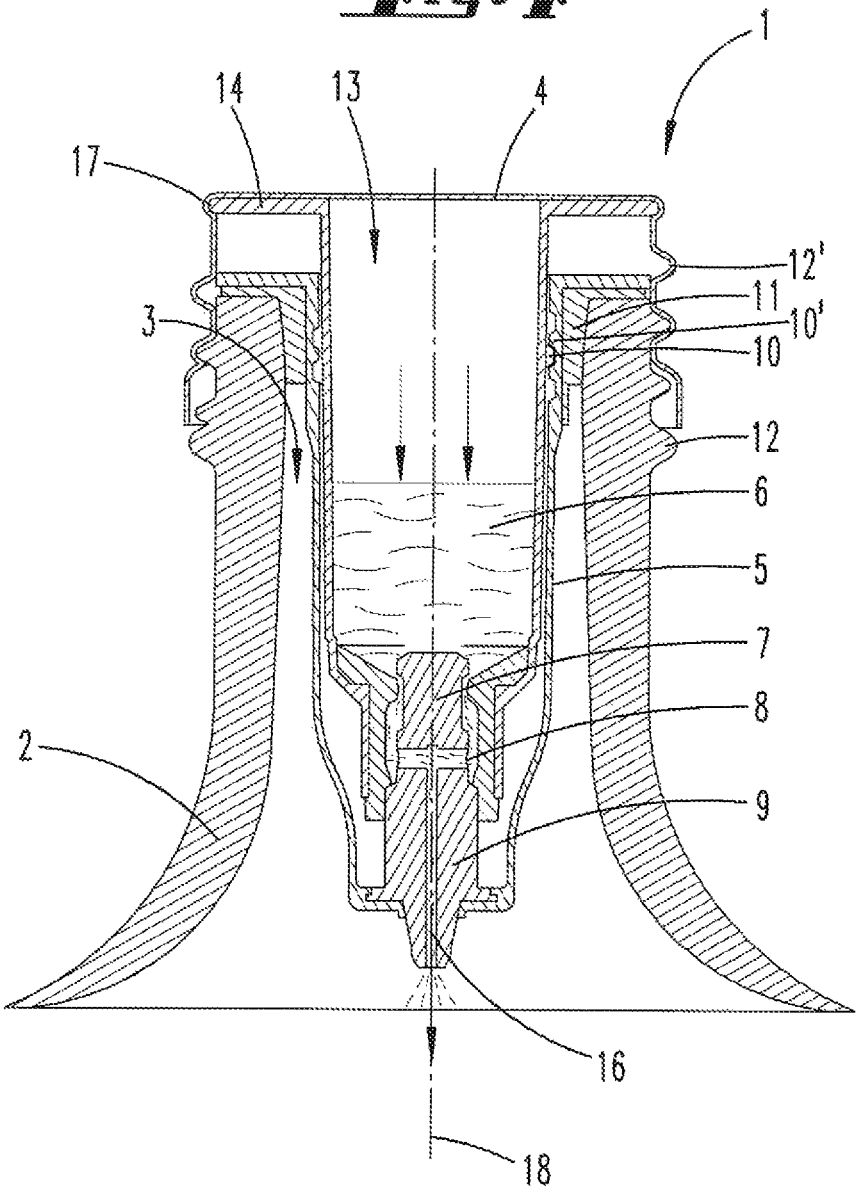
FIG. 4 shows the closure device according to FIG. 2 in the discharge position.

FIG. 4 shows for example the closure device 1 according to FIG. 2 in a discharge position. Although the discharge position is shown here in relation to FIG. 2, this can be designed precisely as a closure device 1 according to FIG. 3. The closure device 1 according to FIG. 4 therefore only serves as an exemplary embodiment for the discharge position and is in no way restrictive.

As shown in FIG. 4, the lid element 4 and the container 2 should be removed from one another to implement a discharge position. As a result of this longitudinal displacement of lid element 4 and container 2, the chamber 6 arranged on the lid element 4 and the inner housing 5 arranged on the container 2 are displaced with respect to one another at the same time. Since the closure means 7 or the opening means 9 are arranged on the inner housing 5, as a result of the displacement of the chamber 6 relative to the inner housing 5, a displacement of the closure means 7 or the opening means 9 inside the closure and opening means of the chamber 6, here the discharge opening 8 takes place simultaneously. This results in the release of the discharge opening 8 so that the medium stored inside the chamber 6 can flow through the discharge opening 8 and the discharge channel 16 formed inside the opening means 9 into the container 2.

In order to bring about a longitudinal movement between the lid element 4 and the container 2, the corresponding second threads 12, 12' formed on the lid element 4 and the container 2 are rotated with respect to one another. This rotation simultaneously results in a rotation of the chamber 6 inside the inner housing 5. This rotation is made possible by the first threads 10, 10' formed on chamber 6 and inner housing 5. Since the inner housing 5 is firmly pressed in the container 2 by means of the press seal 11, during unscrewing of the lid element 4 from the container 2 or rotation of the chamber 6 inside the inner housing 5 the inner housing 5 is connected to the container 2 in a torque-proof manner. Only when the first thread 10 of the chamber 6 has reached an end region of the first thread 10' of the inner housing 5, does this result in a locking of the corresponding first threads 10, 10' with the result that during a further unscrewing of the lid element 4 from the container 2 with the release of the chamber 6 fastened to the lid element 4 from the container 2, the inner housing 5 is simultaneously released from the container 2. In this case, the press seal arranged on the inner housing 5 is also released from the container 2. The pressing force of the press seal 11 inside the container is overcome.

During the unscrewing process the chamber 6 is firstly moved relative to the inner housing 5 so that the chamber 6 simultaneously moves past the closure means 7 or opening means 9 connected to the inner housing 5. In this case, a sub-region of the discharge opening 8 is opened between closure means 7 and inner housing 5 so that the medium stored in the chamber 6 can flow through the discharge channel 16 of the opening means 9 into the container 2.

Figure 5:
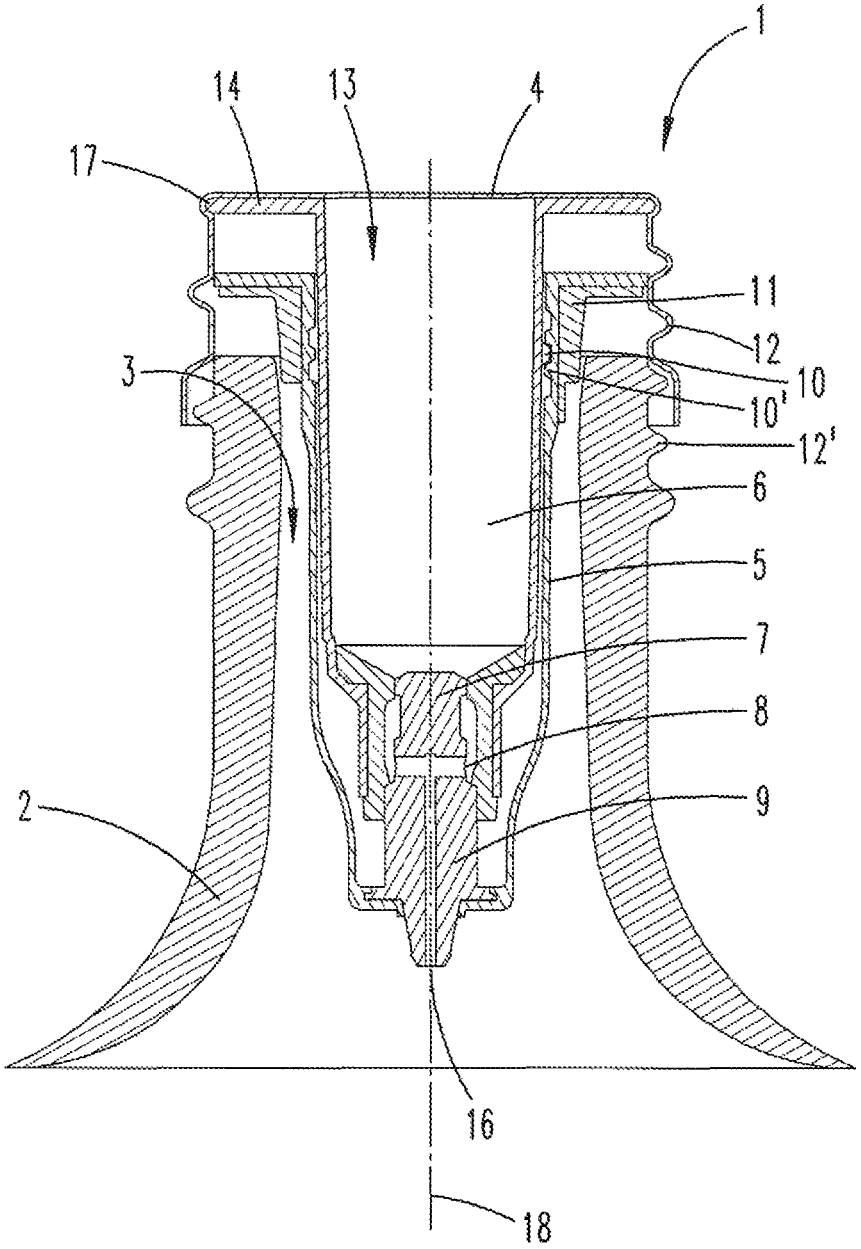
FIG. 5 shows the closure device according to FIG. 2 during unscrewing from a container.

FIG. 5 shows a following position: as raising of the chamber 6 advances, the closure means 7 with its upper end region can enter into a position with respect to the discharge opening 8 in which the discharge opening 8 is closed again so that after-dripping of medium from the chamber 6 is prevented. For this purpose the upper end region of the closure means 7 is usually radially expanded with respect to the adjacent regions of the closure means 7. This position is optional. Finally the second threads 12 of the lid element 4 and the container 2 are separated from one another whilst the first threads 10 of the chamber 6 and the inner housing 5 are located in an end position. In this end position chamber 6 and inner housing 5 can twist further with respect to one another.

Figure 6:
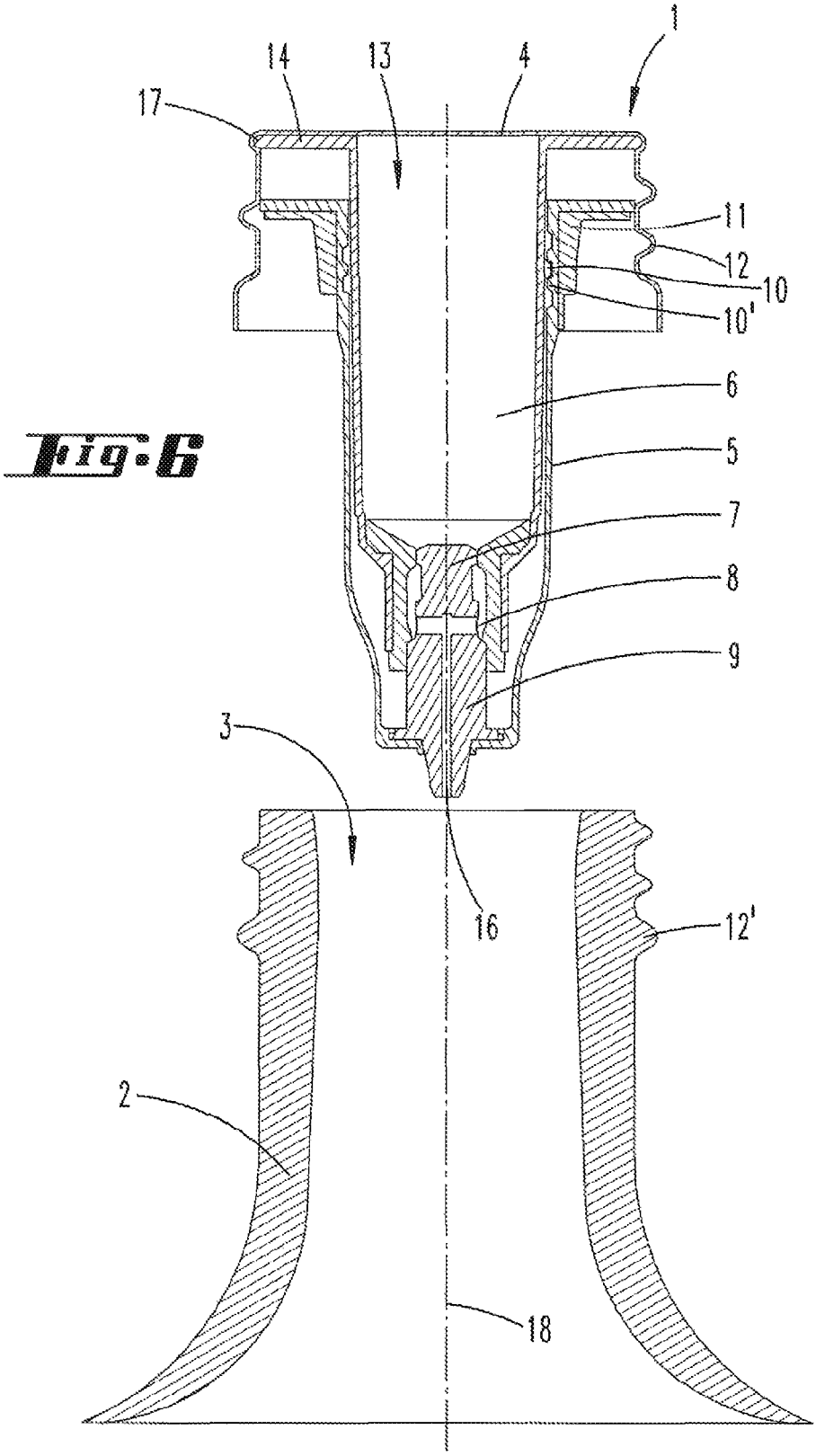
FIG. 6 shows the closure device according to FIG. 2 completely separated from the container.

FIG. 6 finally shows the closure device 1 completely removed from the container 2. The closure means 7 secures the discharge opening 8 of the chamber 6 against after-dripping of the medium from the chamber 6.

Figure 7:
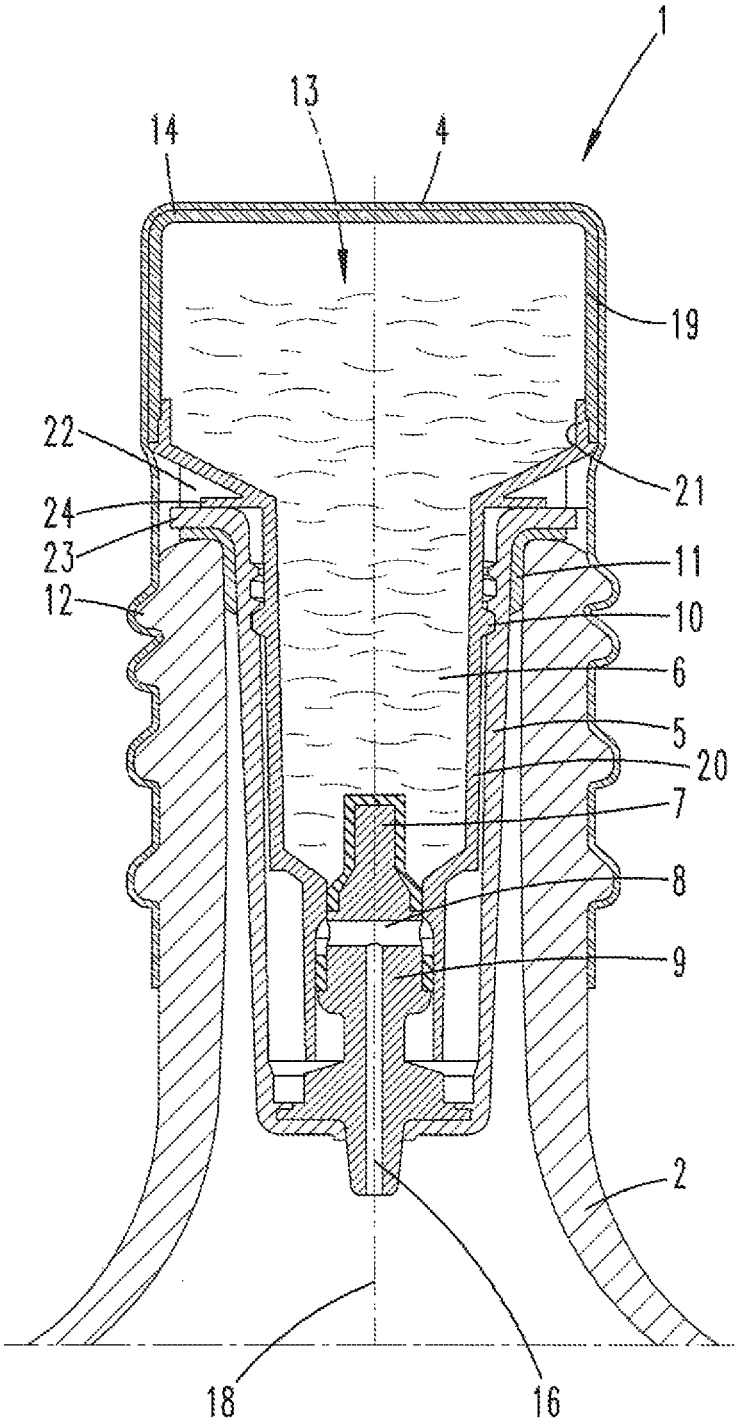
FIG. 7 shows a diagram according to FIG. 1 where however the chamber 6 extends beyond an upper end face of the container 2, in this respect a first embodiment.

In the embodiment of FIG. 7 the chamber 6 is initially formed in two parts. It is divided into an upper dome part 19 and a lower opening part 20. Above an upper end face 21 of the container 2, the opening part 20 goes over into a connection shoulder 22 whilst expanding conically. The connecting shoulder 22 is connected to a dome part 19 which is clearly depicted in a U shape in the cross-sectional view shown. Overall this is a drop-shaped, preferably rotationally symmetrical part, namely formed rotationally symmetrically with respect to the thread axis of rotation 18. The pot base is at the top in the usage state as depicted and the pot edge points downwards. The opening part 20 on the other hand is substantially tubular. Preferably with a larger and a smaller opening. Further preferably, as also shown in the exemplary embodiment, with a larger opening facing the dome part 19 and a smaller opening forming the underside of the discharge opening 8 which receives the closure means 7 in the closed state.

The conically expanding region is supported by means of one or more struts 23 either directly on a chamber flange 23 gripping over the end face 21 and/or on a flange section 24 of the chamber running substantially perpendicular to the thread axis of rotation 18, which also extends ultimately in overlap to the end face 21, but here by means of the flange section 24.

Thus a substantially larger chamber volume can be achieved.

Figure 8:
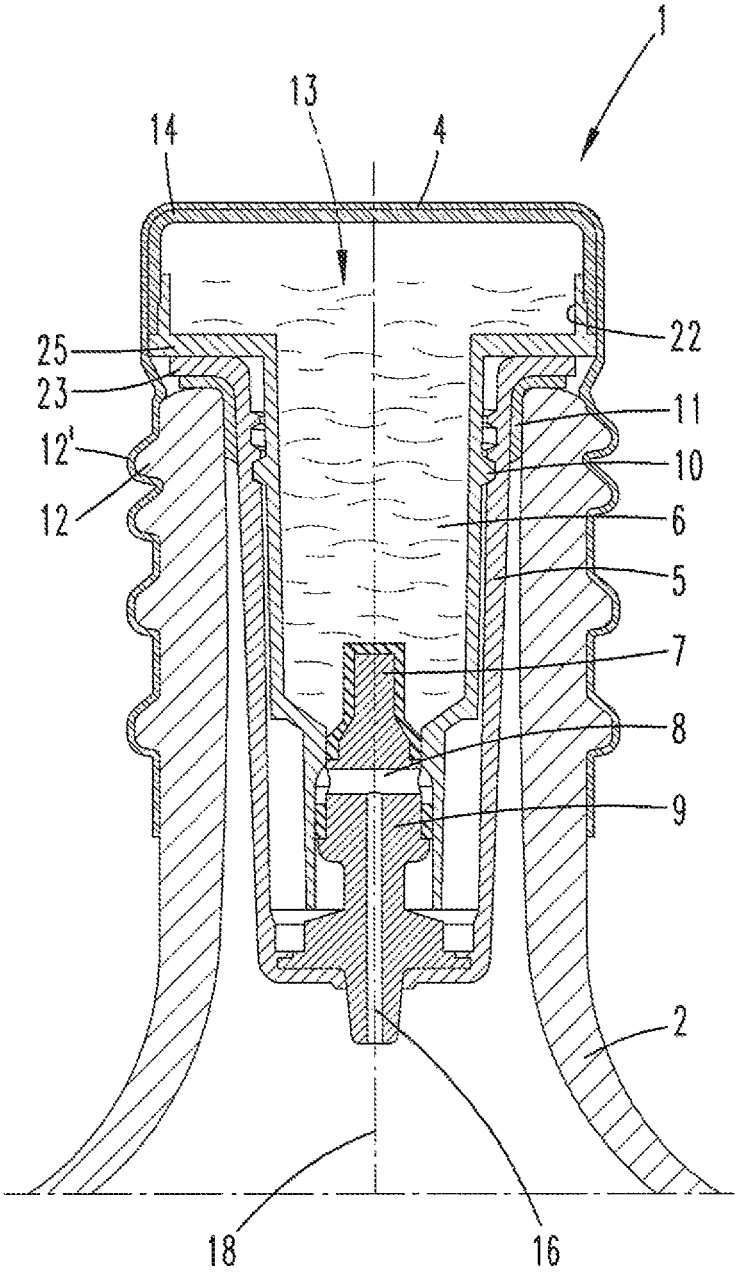
FIG. 8 shows a diagram according to FIG. 7, where the [the chamber] extending over the upper end face of the container 2 is further modified.

In the embodiment of FIG. 8, fundamentally the same conditions are given, only with the difference that the opening part 20 directly above the chamber flange 23 and in the usage state shown resting thereon, goes over into an expansion section 25 extending perpendicular to the thread axis of rotation 18. In relation to the transverse sectional view, the connecting section 22 adjoins the expansion section 25 radially on the outside, approximately perpendicular thereto.

REFERENCE LIST

1 Closure device
2 Container
3 Container opening
4 Lid element
5 Inner housing
6 Chamber
7 Closure means
8 Discharge opening
9 Opening means
10 First thread
10' Second thread
11 Press seal
12 Second thread
12' Second thread
13 Opening
14 Edge region
15 Film element
16 Discharge channel
17 Projection
18 Thread axis of rotation
19 Dome part
20 Opening part
21 End face
22 Connecting section
23 Chamber flange
24 Flange section
25 Expansion section

The invention claimed is:

1. A closure device (1) for a container (2), in particular a glass container, wherein the closure device (1) has a lid element (4) for closing a container opening (3), the lid element being arranged on a chamber (6) and an inner housing (5), wherein the chamber (6) and the inner housing (5) have corresponding closing means (7) and opening means (9), which interact with one another so that a discharge opening (8) within the chamber (6) can be released by a movement of the lid element (4) relative to the inner housing (5), so that a medium stored in the chamber (6) can exit into the container (2), and the chamber (6) and the inner housing (5) each have a corresponding first thread (10, 10') which is formed relative to a thread axis of rotation (19), wherein the first thread (10) on the chamber (6) is arranged so as to point radially outwards when viewed from the thread axis of rotation (19) wherein a second thread (12) for connection to the container (2) is formed on the lid element (4), wherein the lid element (4) is a plastic part and comprises the second thread (12) or the lid element (4) is an aluminium element and comprises a moulded-on second thread (12), and wherein the second thread (12) of the lid element (4) and the container (2) are separable from one another, while the first threads (10) of the chamber (6) and the inner housing (5) are located in an end position in which said first threads cannot twist further with respect to one another.

2. The closure device (1) according to claim 1, wherein the lid element (4) is an aluminium element which can be rolled onto the container (2) for forming the second thread (12), wherein the second thread (12) formed on the lid element (4) corresponds to a second thread (12) of the container (2).

3. The closure device (1) according to claim 1, wherein the inner housing (5) on the side facing away from the first thread (10) has a press seal (11) for bearing against the container (2) in the region of the container opening (3).

4. The closure device (1) according to claim 1, wherein the chamber (6) is welded onto the lid element (4).

5. The closure device (1) according to claim 1, wherein the lid element (4) is a plastic element which has the second thread (12), said second thread (12) corresponding to a second thread (12) of the container (2).

6. The closure device (1) according to claim 5, wherein the chamber (6) has an opening (13) with a collar-shaped chamfered edge region (14), wherein a film element (15) for closing the opening (13) is welded on the edge region (14), and wherein the film element (15) is connected to the lid element (4).

7. The closure device (1) according to claim 1, wherein the discharge opening (8) is provided with the closing means (7) which can be opened by means of the opening means (9) arranged on the inner housing (5).

8. A container (2) having a closure device (1) according to claim 1, wherein the container has a second thread (12) in the region of the container opening (3), which is connected in a positively corresponding manner to the second thread (12) of the lid element (4).

9. A method for dispensing a medium from a closure device (1) into a container (2), in particular from a closure device (1) according to claim 1, wherein the closure device (1) has a lid element (4) for closing a container opening (3), the lid element being arranged on a chamber 6 and an inner housing (5), wherein closing means (7) and opening means (9) assigned to the chamber (6) and the inner housing (5) interact with one another during a movement of the lid element (4) relative to the inner housing (5) so that a discharge opening (8) assigned to the chamber (6) is released, so that a medium stored in the chamber (6) exits into the container (2), wherein further during the movement of the lid element (4) the chamber (6) and the inner housing (5) are moved towards one another by means of a corresponding first thread (10) formed on the chamber (6) and inner housing (5), wherein the chamber is moved by means of a radially outwardly pointing first thread (10) when viewed from a thread axis of rotation (18) of the closure device (1), wherein in order to implement a discharge position the lid element (4) and the container (2) are moved away from one another in order to bring about a longitudinal movement between the lid element (4) and the container (2), corresponding second threads (12, 12') formed on the lid element (4) and the container (2) are rotated with respect to one another.

* * * * *